US012349745B1

(12) United States Patent
Harmon de Clare et al.

(10) Patent No.: US 12,349,745 B1
(45) Date of Patent: Jul. 8, 2025

(54) GARMENT FOR ENHANCING PRIVACY WHILE DIPPING

(71) Applicant: Arapza Store Corporation, Langford (CA)

(72) Inventors: Ann-Marie Harmon de Clare, Sooke (CA); Brian Harmon de Clare, Sooke (CA); Kim Hoffman, Sooke (CA)

(73) Assignee: Arapza Store Corporation, Langford (CA)

( * ) Notice: Subject to any disclaimer, the term of this patent is extended or adjusted under 35 U.S.C. 154(b) by 0 days.

(21) Appl. No.: 19/009,925

(22) Filed: Jan. 4, 2025

(51) Int. Cl.
*A41D 1/00* (2018.01)
*A41D 7/00* (2006.01)
*A41D 27/20* (2006.01)

(52) U.S. Cl.
CPC ..... *A41D 1/00* (2013.01); *A41D 7/006* (2013.01); *A41D 27/201* (2013.01)

(58) Field of Classification Search
CPC ..... A41D 7/006; A41D 27/201
See application file for complete search history.

(56) References Cited

U.S. PATENT DOCUMENTS 413,426 A 10/1889 Wood
1,281,625 A 10/1918 Mattern
1,592,562 A 7/1926 Graham
2,015,589 A 9/1935 Cahn
2,717,390 A 9/1955 Houze
3,771,172 A 11/1973 Barg
3,958,274 A * 5/1976 Klauber ..... A41D 15/04 5/420
4,078,264 A * 3/1978 DeGennaro ..... A41D 15/04 2/88
4,347,629 A * 9/1982 Itoi ..... A45F 4/12 2/108
4,543,668 A 10/1985 Franklin
D296,605 S * 7/1988 Asher ..... 2/69
5,056,160 A 10/1991 Buchanan
5,564,125 A * 10/1996 Waldman ..... A41D 15/04 224/586
5,611,083 A * 3/1997 Arnold ..... A41D 7/008 2/84
5,799,336 A * 9/1998 Cooper ..... A41D 27/20 2/920
5,855,021 A 1/1999 Somerville
5,884,331 A * 3/1999 Barajas ..... A41D 15/04 5/636

(Continued)

FOREIGN PATENT DOCUMENTS

CN 217743221 6/2022
CN 221355849 7/2024

(Continued)

*Primary Examiner* — Gloria M Hale
(74) *Attorney, Agent, or Firm* — The Law Office of Kevin McDermott, P.L.L.C.

(57) ABSTRACT

A garment for enhancing privacy while dipping is provided that includes a front face and a back face. The back face includes a bag in an inside out orientation. The bag has a top end and a bottom end. Moreover, the garment includes a right side, a left side, a top side, a bottom side, and a disc having a first surface and a second surface. The disc is removably attached to the front face of the garment and is positioned at the bottom end of the bag to form a base of the bag.

20 Claims, 7 Drawing Sheets

(56) References Cited

U.S. PATENT DOCUMENTS

| | | | | |
|---|---|---|---|---|
| 6,393,637 | B1 * | 5/2002 | Hoffman | A41D 15/04 5/413 R |
| D458,435 | S | 6/2002 | Rogone et al. | |
| 6,434,801 | B2 | 8/2002 | Grunberger | |
| 6,708,343 | B1 * | 3/2004 | Ceron | A41D 15/04 2/84 |
| 8,370,964 | B1 | 2/2013 | Kaper | |
| D698,517 | S | 2/2014 | McNamara | |
| 8,640,262 | B2 * | 2/2014 | Rossi | A41D 7/008 2/84 |
| 9,210,953 | B2 | 12/2015 | Horton | |
| D747,593 | S | 1/2016 | Caco | |
| 9,588,053 | B2 | 3/2017 | Nieten et al. | |
| 10,045,574 | B2 | 8/2018 | Darnell | |
| 10,609,969 | B2 | 4/2020 | Castellano et al. | |
| D917,832 | S | 5/2021 | Habelmann | |
| D971,558 | S | 12/2022 | Peterson et al. | |
| 2003/0196240 | A1 | 10/2003 | Meacham et al. | |
| 2005/0044606 | A1 | 3/2005 | Flanagan-Frazier | |
| 2006/0010555 | A1 | 1/2006 | Hayes et al. | |
| 2007/0017000 | A1 | 1/2007 | Segal | |
| 2007/0061940 | A1 | 3/2007 | Cazares | |
| 2007/0101481 | A1 | 5/2007 | Stokesbary | |
| 2011/0206299 | A1 * | 8/2011 | Carmody | B65D 81/363 2/87 |
| 2017/0196276 | A1 | 7/2017 | Park | |
| 2017/0273370 | A1 | 9/2017 | Harvey | |
| 2019/0150529 | A1 | 5/2019 | Caratelli | |
| 2022/0322759 | A1 | 10/2022 | Peterson et al. | |
| 2023/0021822 | A1 * | 1/2023 | Tam | G06Q 30/014 |

FOREIGN PATENT DOCUMENTS

| | | |
|---|---|---|
| DE | 825 384 | 12/1951 |
| DE | 7 818 801 | 10/1978 |
| WO | WO 89/02229 | 3/1989 |

* cited by examiner

GARMENT FOR ENHANCING PRIVACY WHILE DIPPING

BACKGROUND OF THE INVENTION

This invention relates generally to garments for dipping, and more particularly, to a garment for enhancing privacy while dipping.

Many jurisdictions have laws prohibiting public nudity. However, many people enjoy relaxing free and naturally nude while immersed in natural bodies of water like a lake or the ocean. Such immersion type activity is known as dipping or skinny dipping. While many people enjoy dipping, transitioning from a clothed state to an unclothed state before entering the water without violating public nudity laws can be difficult.

People wishing to skinny dip in an area which is not private have to be covered on approaches into and out of the water and have been known to transition from a clothed state to an unclothed state using swimsuits or wraps. People have been known to wear their swim suits while approaching and wading into the water. Once immersed, people pull off and step out of their swim suits. When the dip is finished and while immersed in the water, people step back into their swim suits before wading out of the water. However, stepping into and out of the swim suits while in the water can be especially difficult in cold water because people may lose their balance while doing so. People have been known to fall into the water while stepping into or out of their swim suits and accidently submerging their heads which is unsafe and could perhaps expose the dipper for all to see.

Known wraps are for dry land use and if used in cold water can be difficult to open and close with gloves and cold hands. Additionally, wraps are not typically attached to the person so tend to float away while dipping. Thus, using swimsuits or wraps for a skinny dip can be awkward.

In view of the above, it can be seen that there is currently no garment appropriate for facilitating the safe private transition from a clothed state to an unclothed state to enhance the privacy of a person during and after dipping. Thus, it would be advantageous and an improvement over the relevant technology to provide a garment that reduces the risks of a loss of balance, reduces concerns about the garment floating away, minimizes reveals and can be used without violating public nudity laws to thus enhance the privacy and feelings of liberation for dippers.

BRIEF DESCRIPTION OF THE INVENTION

In one aspect, a garment for enhancing privacy while dipping is provided that includes a front face and a back face. The back face includes a bag in an inside-out orientation. The bag has a top end and a bottom end. Furthermore, the garment includes a right side, a left side, a top side, a bottom side, and a disc having a first face and a second face. The disc is removably attached to the front face of the garment and is positioned at the bottom end of the bag to form a base of the bag.

In one embodiment of the present disclosure a part of the garment is wrapped over the disc and a flexible ring is wrapped at least once about the front face of the garment proximate the second face of the disc to removably attach the disc to the garment and to create a distance between the disc and the garment.

In another embodiment of the present disclosure the distance between the disc and the garment is variable.

In yet another embodiment of the present disclosure the top end of the bag includes an opening, the top end of the bag faces the bottom side of the garment while the garment is worn by a person, and the bottom end of the bag faces the top side of the garment while the garment is worn by the person.

In yet another embodiment of the present disclosure the garment is configured to be wrapped-up into the bag. The top end of the bag includes an opening. The bag is configured to be manipulated into a right side out orientation and to receive through the opening the wrapped-up garment in the right side out orientation. A cord in the top end of the bag is configured to tighten and close the opening to secure the garment in the bag and a closure flap attached to the bag covers the top end of the bag.

In yet another embodiment of the present disclosure the bottom side of the garment extends a length of the garment from the right side to the left side. The bottom side of the garment includes a plurality of pockets. Each pocket includes a weight.

In yet another embodiment of the present disclosure the top side of the garment extends between the right and left sides. The top side includes a first row of pockets and a second row of pockets. One pocket in each row includes a magnet.

In yet another embodiment of the present disclosure the disc includes a concentric aperture and a cord is securely attached to the disc. The cord extends through the aperture from the bottom end of the bag to the top end of the bag to function as a pull string to open and close the bag.

In yet another embodiment of the present disclosure a device is removably attached to the garment proximate the disc.

In yet another embodiment of the present disclosure the device includes at least one of a thermometer, a timer, or a biometric device that measures certain vital health parameters of the person.

In another aspect of the present disclosure a garment for enhancing privacy while dipping is provided that includes a front face, a back face, a right side, a left side, a top side, and a bottom side. A bag is attached to the back face. The bag has a top end and a bottom end. The top side includes a first row of pockets and a second row of pockets. A first magnet is positioned in one of the first row pockets and a second magnet is positioned in one of the second row pockets. The first and second magnets engage each other to securely close the garment about a person. When the person wearing the garment is immersed in a natural body of water, the magnets are configured to be disengaged to open the garment so the person can experience discrete natural nude water dipping.

In one embodiment of the present disclosure the garment includes straps which prevent the garment from disengaging from the person while the person is immersed in water.

In another embodiment of the present disclosure the bottom side includes pockets. Each pocket includes a weight. The force exerted by the weights on the garment exceeds the buoyant force of the water acting on the garment to cause the garment to remain on the person.

In yet another embodiment of the present disclosure the garment is configured to remain on the person while the person changes clothes beneath the garment.

In yet another embodiment of the present disclosure the garment is configured to be removed and wrapped-up after the person changes clothes, and the bag is configured to be manipulated from an inside out orientation to a right side out orientation and to receive the wrapped-up garment in the right side out orientation.

In yet another embodiment of the present disclosure a disc having a first surface and a second surface is removably attached to the garment and is positioned at the bottom end of the bag to form a base of the bag. The bag is in an inside out orientation.

In yet another embodiment of the present disclosure a part of the garment is wrapped over the disc. A flexible ring is wrapped at least once about the front face of the garment proximate the first or second surface of the disc to removably attach the disc to the garment and to create a distance between the disc and the garment.

In yet another embodiment of the present disclosure the top side of the garment extends between the right and left sides, the top side includes a first row of pockets and a second row of pockets, and one pocket in each row includes a magnet.

In yet another embodiment of the present disclosure the disc includes a concentric aperture, a cord is securely attached to the disc, and the cord extends through the aperture from the bottom end of the bag to the top end of the bag to function as a pull string to open and close the bag.

DETAILED DESCRIPTION OF THE INVENTION

The following detailed description is made with reference to the accompanying drawings and is provided to assist in a comprehensive understanding of various example embodiments of the present disclosure. The following description includes various details to assist in that understanding, but these are to be regarded merely as examples and not for the purpose of limiting the present disclosure as defined by the appended claims and their equivalents. The words and phrases used in the following description are merely used to enable a clear and consistent understanding of the present disclosure. In addition, descriptions of well-known structures, functions, and configurations may have been omitted for clarity and conciseness. Those of ordinary skill in the art will recognize that various changes and modifications of the example embodiments described herein can be made without departing from the spirit and scope of the present disclosure.

Figure 1:
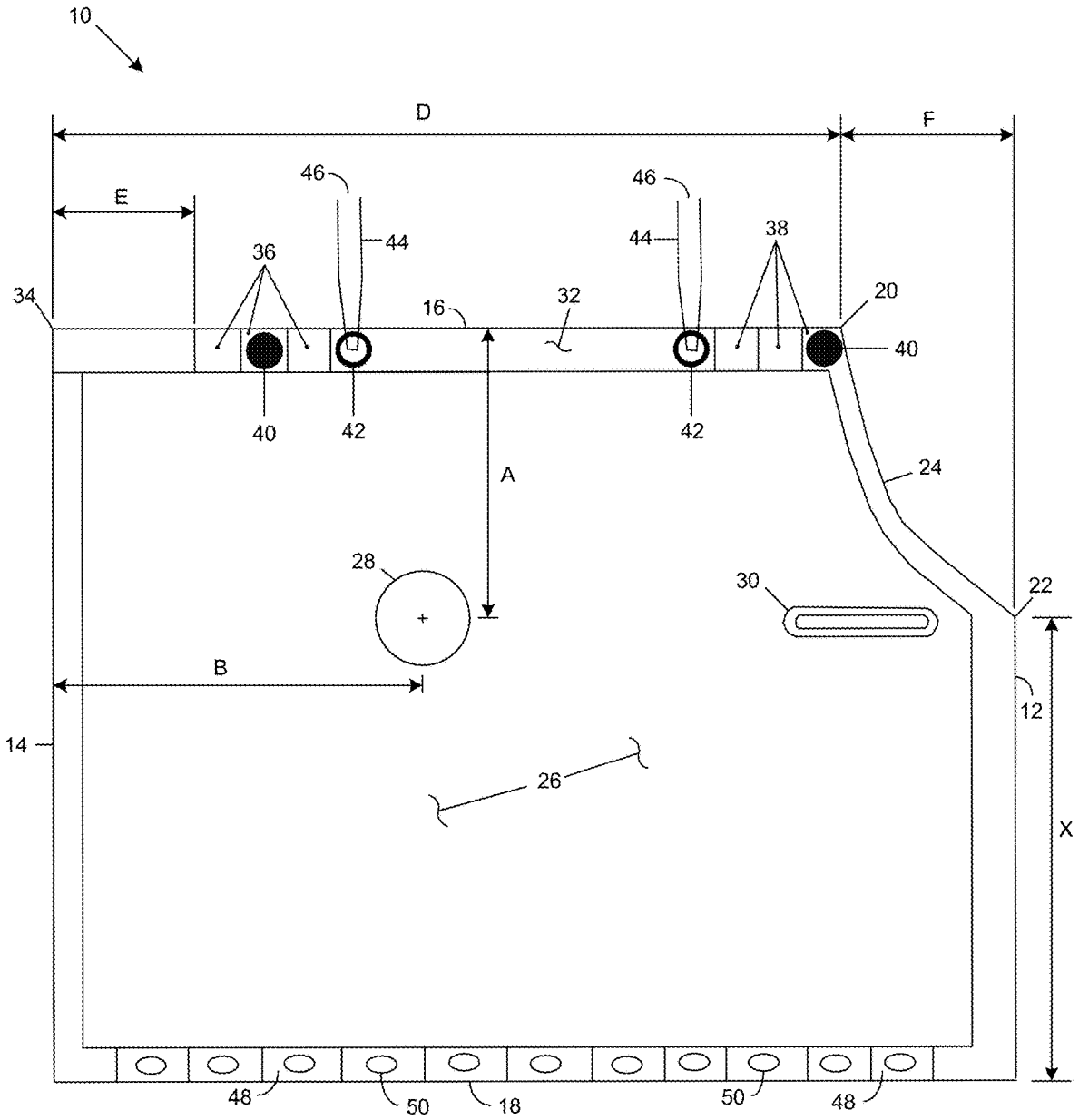
FIG. 1 is a diagram illustrating a front view of an example garment used for enhancing privacy while dipping according to an embodiment of the present disclosure.

FIG. 1 is a diagram illustrating a front view of an example garment 10 for enhancing privacy while dipping in accordance with an embodiment of the present disclosure. The garment 10 may enhance privacy before, during and after dipping. The garment 10 can be made from light weight fabric including, but not limited to, nylon and polyester. Moreover, the garment 10 may have a nanoparticle coating to facilitate keeping the garment 10 clean and less prone to corrosive damage from seawater. Alternatively, the garment 10 may have any type of coating that facilitates keeping the garment 10 clean and less prone to corrosive damage from seawater.

The garment 10 has a generally rectangular shape. The garment 10 includes a right side 12, a left side 14, a top side 16, and a bottom side 18. However, the top 16 and right 12 sides do not meet at a corner.

The top 16 and bottom 18 sides are generally parallel but have different lengths. For example, the top side 16 can be shorter than the bottom side 18. The right 12 and left 14 sides are also generally parallel and are also of different lengths. For example, the right side 12 can be shorter than the left side 14.

The top side 16 extends from the left side 14 a distance D towards the right side 12 to a terminus 20. The right side 12 extends from the bottom side 18 a distance X to an end point 22. A curved side 24 of the garment 10 extends between the terminus 20 and the end point 22. The curved side 24 may be, for example, part of an oval or part of a circle.

The garment 10 has a front face 26 that extends between the top side 16, the right side 12, the bottom side 18, the left side 14 and the curved side 24. An example disc 28 is removably attached to the front face 26. The front face 26 includes the disc 28 and, for example, a button hole 30.

A center of the disc 28 can be positioned a distance A from the top side 16 and a distance B from the left side 14. The distances A and B may be, for example, 12 inches and 16 inches, respectively. Alternatively, the distances A and B may be any distances that facilitate aligning and engaging the disc 28 with the button hole 30 in a manner that permits the disc 28 and the button hole 30 to cooperate to close the garment 10 about a person.

The disc 28 functions as a button which is inserted into the button hole 30 to thus effectively fasten the right 12 and left 14 sides of the garment 10 together. Thus, the disc 28 and button hole 30 function as a closure mechanism which secures the garment 10 closed. The disc 28 and button hole 30 closure mechanism also functions to gather excess fabric of the garment 10 from above the waistline across the back of a person, giving the garment 10 a more fitted look.

The button hole 30 may be located proximate the end point 22, and can be an elongated opening that is generally parallel to the top 16 and bottom 18 sides of the garment 10. Alternatively, the button hole 30 may alternatively be parallel to the right 12 and left 14 sides or may alternatively have any orientation that permits the disc 28 and the button hole 30 to cooperate to securely close the garment 10. The button hole 30 may alternatively have any shape, for example, oval that accommodates the disc 28 when a person wears the garment 10. Although the garment 10 is described herein as including a button hole 30, it is contemplated by the present disclosure that the garment may alternatively include an elastic loop attached proximate the end point 22 configured to engage the disc 28 to effectively fasten the right 12 and the left 14 sides of the garment 10 together.

The top side 16 includes a chest band 32 that extends along the top side 16 from the terminus 20 to an opposite end 34 of the top side 16. The chest band 32 can be, for example, one inch wide. Alternatively, the chest band 32 may have any width including greater than or less than one inch. The chest band 32 includes a first row of pockets 36 and a second row of pockets 38. The first row of pockets 36 is positioned between the end 34 and a middle of the chest band 32. The second row of pockets 38 extends from the terminus 20 towards the middle of the chest band 32. Each row includes three pockets. However, each row may alternatively include any number of pockets. The number of pockets in each row can be different.

Each row of pockets includes one magnet 40. For example, a magnet 40 may be positioned in any one of the pockets 36 and another magnet 40 may be positioned in any one of the pockets 38. Alternatively, each row may include one or more magnets 40. For example, a magnet 40 may be positioned in each pocket 36 and in each pocket 38, or a magnet 40 may be positioned in one of the pockets 36 while a magnet 40 is positioned in each of the pockets 38.

The magnets 40 may be secured in the pockets 36, 38 by, for example, sewing the pockets shut, using Velcro to close the pockets, or adding a fold of fabric to the inside and top of each pocket 36, 38 capable of folding back within the pockets 36, 38 to prevent a magnet 40 from falling out during use. The magnets 40 are coated with a protective layer to prevent corrosion.

The magnets 40 function as fasteners that facilitate opening and closing the garment 10 about a person. While wrapping the garment 10 around a person, the magnet 40 in one of the pockets 36 will be magnetically attracted to the magnet 40 in one of the pockets 38. The magnetic attraction pulls the magnets 40 together which causes the chest band 32 to close about the chest of the person. The magnets 40 in the pockets 36 and the magnets 40 in the pockets 38 should have opposite polarity.

The magnets 40 should be positioned in the pockets 36, 38 in a manner that facilitates securely fitting the chest band 32 about the chest of a person wearing the garment 10. Because the magnets 40 may be placed in different pockets 36, 38 the chest band 32 can be adjusted to fit the chests of different people. Thus, the garment 10 is adjustable. Because the garment 10 is adjustable, the same garment 10 can be used by people of different sizes.

Although magnets 40 are described herein as facilitating easily opening and closing the garment 10, it is contemplated by the present disclosure that other types of fasteners may alternatively be used. For example, hooks, clips, ties and self-gripping fabric may alternatively be used to facilitate closing the garment 10. The magnets 40 positioned in the pockets 36, 38, and the disc 28 and button hole 30 closure mechanism enable a wearer of the garment 10 to easily and conveniently control opening and closing the garment 10 to thus enhance privacy before, during, and after dipping.

Cold water immersion, or dipping, typically requires gloves for comfort while in the water. The gloves reduce finger dexterity. As a result, it is difficult for people to operate typical clothing fasteners, for example, buttons and clips while in the water. People wearing the garment 10 may easily separate the magnets 40 to open the garment 10 while in the water. Similarly, while in the water people may easily move the chest band 32 so the magnets 40 move towards each other to close the chest band 32 and thus the garment 10. The magnets 40 thus facilitate easily and conveniently opening and closing the garment 10 without using fingers.

The chest band 32 also includes two or more apertures 42. One of the apertures 42 may be positioned near the pockets 36 and the other aperture 42 may be positioned near the pockets 38. The apertures 42 may be, for example, circular. Alternatively, the apertures may be any shape including, but not limited to, oval, square, diamond or rectangular. The apertures may be non-corrosive metal rings. A shoulder strap 44 is attached to and passes through each aperture 42. The shoulder straps 44 are tied behind the neck of the person while dipping.

The shoulder strap 44 is the only part of the garment 10 that attaches to the person and prevents the garment 10 from coming off the person while dipping. The shoulder ties 44 are made of elastic bathing suit material that untangles easily and are securely tied. Each shoulder tie 44 has an end 46. The ends 46 attach to each other behind the person's neck using, for example, complementary hooks or clips. Alternatively, self-adhesive fasteners, for example, Velcro, or a self-gripping toggle may be arranged on each end 46.

The bottom side 18 of the garment 10 includes pockets 48. Any number of sealed pockets 48 may be included in the bottom side 18 in a double folded hem. The pockets 48 may be, for example, sewn closed or closed with another type of fastener. The pockets 48 may be the same size or different sizes. Weights 50 may be placed in the pockets 48 to prevent the garment 10 from blowing up, for example, due to wind, waves or swelling in, for example, the ocean or a large lake while the person approaches the water. Additionally, the weights 50 operate to counter buoyant forces of water acting on the garment 10 while dipping. Thus, the weights 50 facilitate preventing the garment 10 from floating away while a person is in the water. The weights 50 include, but are not limited to, glass beads, pebbles and sand.

The garment 10 also includes a first overlap portion E and a second overlap portion F. The first overlap portion E extends from the end 34 to the first row of pockets 36 and the second overlap portion F extends from the terminus 20 to the end point 22. The first overlap portion E also extends from the top side 16 to the bottom side 18 of the garment 10, while the second overlap portion F extends from the curved side 24 to the bottom side of the garment 10. When the garment 10 is closed about a person, the first E and second F overlapping portions overlap to facilitate a secure and comfortable fit.

Figure 2:
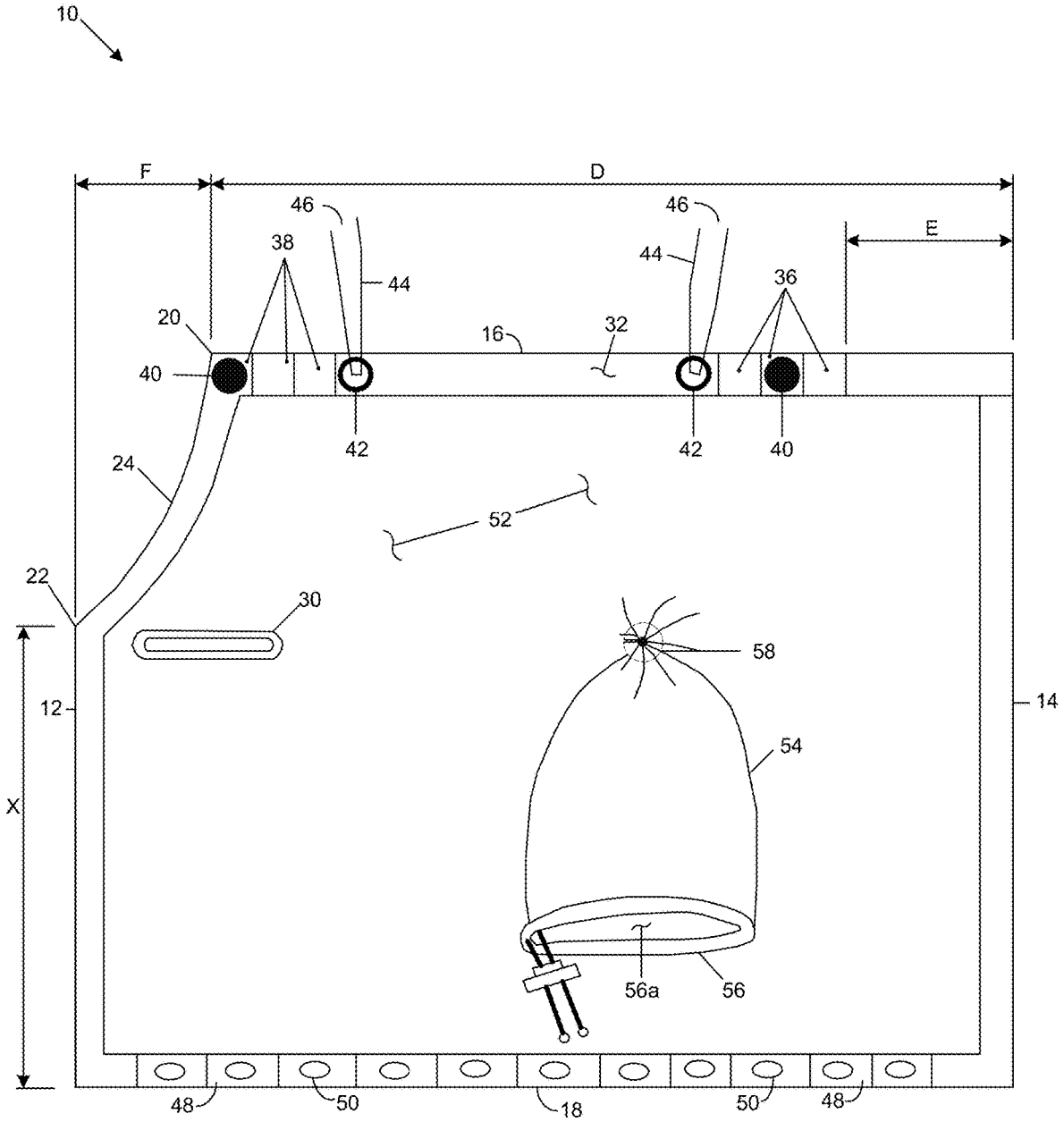
FIG. 2 is a diagram illustrating a back surface of the garment including an example bag.

The information shown in FIG. 2 is similar to the information as shown in FIG. 1, as described in more detail below. As such, components illustrated in FIG. 2 that are identical to components illustrated in FIG. 1, are identified using the same reference numerals used in FIG. 1.

FIG. 2 is a diagram illustrating a back face 52 of the garment 10. The back face 52 of the garment 10 is similar to the front face 26 as shown in FIG. 1. However, a bag 54 is removably attached to the back face 52. The bag 54 is upside down and inside out. The bag 54 includes a top end 56 and a bottom end 58. The top end 56 of the bag includes an opening 56*a* and is proximate the bottom side 18 of the garment 10. The position of the bottom end 58 on the back face 52 corresponds to the position of the disc 28 on the front face 26. The bottom end 58 of the bag 54 is removably attached to the back face 52. The bag 54 can be made from the same material as the garment 10 or from another water-resistant material.

Figure 3:
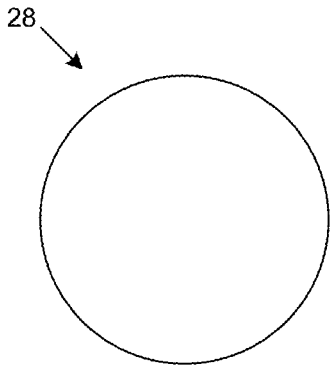
FIG. 3 is a diagram illustrating a plan view of an example disc.

FIG. 3 is a diagram illustrating a plan view of the example disc 28. The disc 28 may have a three-inch diameter. Alternatively, the disc 28 may have any diameter that facilitates closing the garment 10 about a person in conjunction with the button hole 30.

Figure 4:
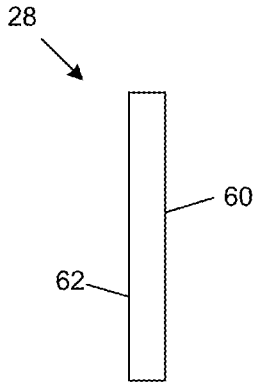
FIG. 4 is a diagram illustrating a side view of the disc.

FIG. 4 is a diagram illustrating a side view of the disc 28. The disc 28 has a first surface 60 and a second surface 62. The surfaces 60, 62 can be flat. Alternatively, the surfaces may not be flat. For example, the surfaces 60, 62 may be curved. The thickness of the disc 28 may be, for example, one quarter of an inch. Alternatively, the disc 28 may have any thickness that facilitates closing the garment 10 about a person in cooperation with the button hole 30.

Figure 5:
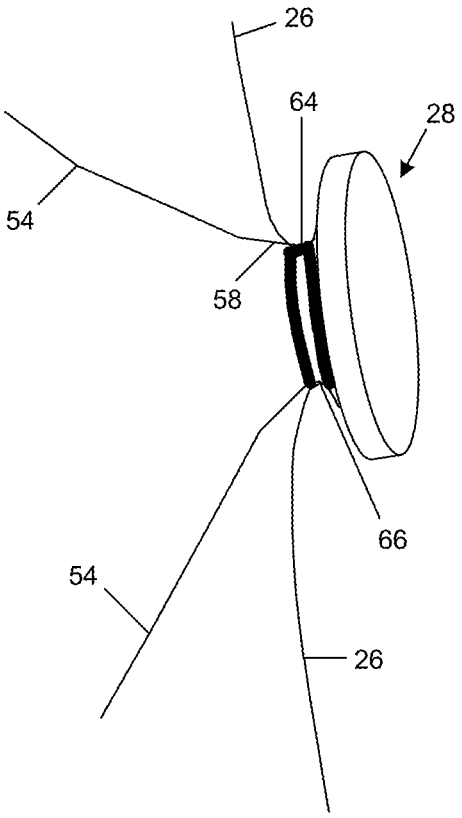
FIG. 5 is a diagram illustrating a perspective view of the disc attached to the garment according to an embodiment of the present disclosure.

FIG. 5 is a diagram illustrating a perspective view of the disc 28 attached to the garment 10 according to an embodiment of the present disclosure. The disc 28 is effectively encapsulated by the back face 52 of the garment 10. More specifically, the disc 28 is placed on the back face 52 of the garment 10 and the bottom end 58 of the bag 54 may be positioned on the disc 28. The garment 10 may be manipulated such that the back face 52 tightly covers the perimeter and the back face 62 of the disc 28 as well as the bottom end 58 of the bag 54. The garment is gathered to form a length of material 64 between the disc 28 and the front surface 26 of the garment 10. The length of material 64 is also the distance between the disc 28 and the garment 10. The length of material 64 is variable.

A flexible ring 66 is wrapped about the length of material 64 to compress the material 64. The compressed length of material 64 facilitates encapsulating the disc 28 and keeping the disc 28 stationary. The compressed length of material 64 also functions to compress the bottom end 58 of the bag 54 to thus attach the bag 54 to the garment 10. The flexible ring 66 may be, for example, an ultra violet light resistant waterproof silicone rubber, or an elastic polyester spandex blend band.

Removing the flexible ring 66 decompresses the length of material 64 which causes the length of material 64 to release the bag 54 and the disc 28. Thus, the disc 28 and the bag 54 can be are removably attached to the garment 10. It is contemplated by the present disclosure that discs 28 of different diameters may be removably attached to the garment 10. The differently sized discs 28 can be used interchangeably. The length of material 64 varies with the diameter of the disc 28.

Figure 6:
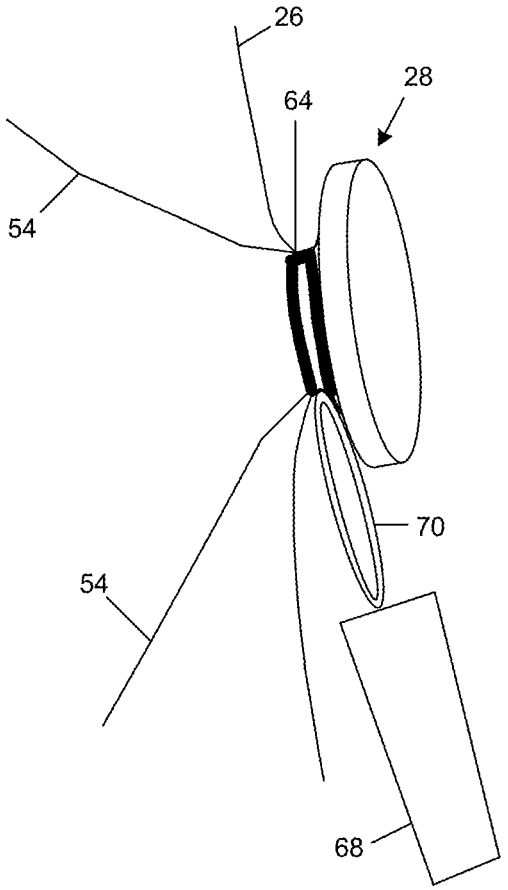
FIG. 6 is a diagram illustrating the perspective view of the disc attached to the garment as shown in FIG. 5, further including a device that provides information to a person wearing the garment.

The information shown in FIG. 6 is identical to the information shown in FIG. 5, as described in more detail below. As such, components illustrated in FIG. 6 that are identical to components illustrated in FIG. 5, are identified using the same reference numerals used in FIG. 5.

FIG. 6 is a diagram illustrating the perspective view of the disc 28 attached to the garment 10 as shown in FIG. 5, further including a device 68 that provides information to the person wearing the garment 10. The information device 68 can be attached to the length of material 64 in any manner including, but not limited to, a loop of fabric material, ultra violet light resistant silicone chips, non-corrosive metal fasteners and plastic clips 70. The device 68 can be any type of device that provides useful information to the person wearing the garment 10 while dipping. For example, the device 68 may be a thermometer, a waterproof timer, or a biometric device that measures certain vital health parameters of the person. The device 68 may be capable of issuing an alarm to notify a person wearing the garment 10, for example, that the water is a certain temperature. Alternatively, or additionally, a water proof pocket or small pouch may be attached to the length of material 64. The small pouch may be used to hold personal items, for example, car keys or wedding bands.

Figure 7:
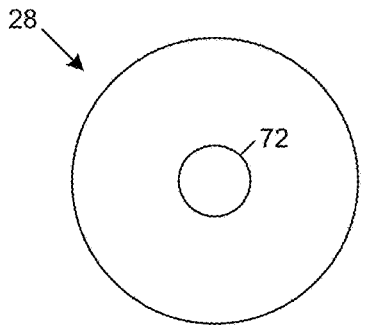
FIG. 7 is a diagram illustrating the example disc as shown in FIG. 3, further including an example circular aperture.

FIG. 7 is a diagram illustrating the example disc 28 as shown in FIG. 3, further including an example circular aperture 72. The aperture 72 is concentric with the disc 28. Although the aperture 72 is described herein as being circular, the aperture 72 may alternatively have any shape, for example, oval.

Figure 8:
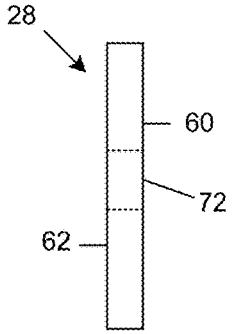
FIG. 8 is a diagram illustrating the side view of the disc as shown in FIG. 4, further including the aperture.

FIG. 8 is a diagram illustrating the side view of the disc 28 as shown in FIG. 4, further including the aperture 72. The aperture 72 extends from the first surface 60 to the second surface 62.

Figure 9:
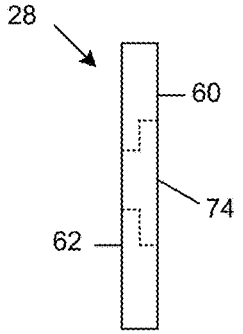
FIG. 9 is a diagram illustrating the side view of the disc as shown in FIG. 8, wherein the aperture includes a counterbore.

FIG. 9 is a diagram illustrating the side view of the disc 28 as shown in FIG. 8 wherein the aperture 72 further includes a counterbore 74.

Figure 10:
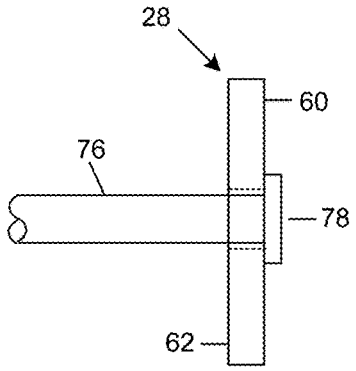
FIG. 10 is a diagram illustrating the side view of the disc as shown in FIG. 8, further including an example cord extending through the aperture.

FIG. 10 is a diagram illustrating the side view of the disc 28 as shown in FIG. 8, further including an example cord 76 extending through the aperture 72. The cord 76 can be tied into a knot 78 on the first surface 60 side of the disc 28. The knot 78 engages the first surface 60. As a result, the knot 78 prevents the cord from separating from the disc 28. The knot 78 may form a bump in the button on the front face 26 of the garment 10.

Figure 11:
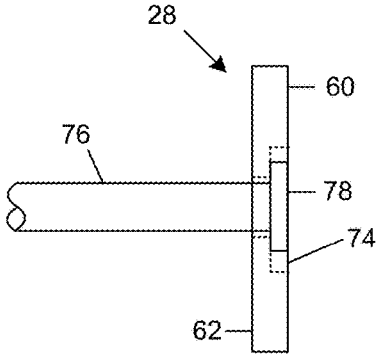
FIG. 11 is a diagram illustrating the disc as shown in FIG. 9, further including the cord extending through the aperture.

FIG. 11 is a diagram illustrating the example disc 28 as shown in FIG. 9, further including the cord 76 extending through the aperture 72. The knot 78 is positioned in the counterbore 74 to facilitate removing any bump that may develop on the button on the front face 26 of the garment. Although the knot 78 engages the first surface 60 of the disc 28 to prevent the cord from separating from the disc 28 as described herein, it is contemplated by the present disclosure that any other device may be connected to the cord 76 that is capable of engaging the first surface 60 to facilitate preventing the cord 76 from separating from the disc 28.

Figure 12:
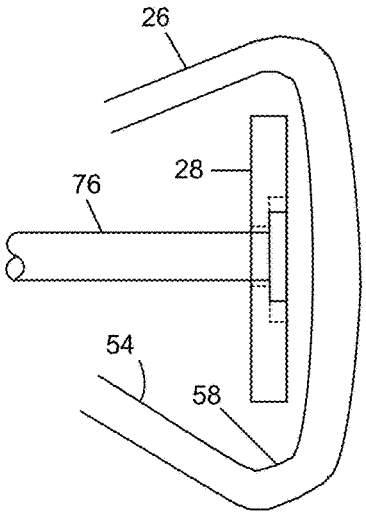
FIG. 12 is a diagram illustrating attachment of the disc and cord to the garment according to another embodiment of the present disclosure.

FIG. 12 is a diagram illustrating attachment of the disc 28 and cord 76 to the garment 10 according to another embodiment of the present disclosure. More specifically, the end 58 of the bag 54 is wrapped about the disc 28. The back face 52 of the garment 10 is then positioned over the bag 54 and wrapped about the bag 54 and disc 28. The bag 54 and garment 10 are manipulated such that the bag 54 and garment 10 tightly cover the first surface 60 of the disc 28.

The bag 54 and garment 10 can be gathered to form a length of material 64 between the disc 28 and the front surface 26 of the garment 10. The flexible ring 66 is wrapped around the length of material 64 to compress the length of material 64. The compressed length of material 64 facilitates encapsulating the disc 28 and keeping the disc 28 stationary. As a result, the cord 76 is securely attached to the disc 28 and the bottom 58 of the bag 54. Attaching the cord 76 to the bag 54 in this manner does not rely on a sewn seam which can weaken over time due to use. Such use may include carrying items heavier than keys or wedding bands, for example, a large bottle of soda or electronics equipment.

Figure 13:
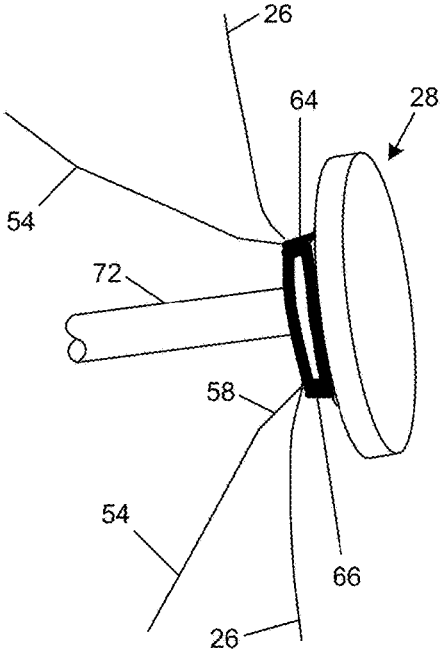
FIG. 13 is a diagram illustrating a perspective view of the disc as shown in FIG. 5, wherein the disc is wrapped in the bag and the garment and further includes the cord.

FIG. 13 is a diagram illustrating a perspective view of the disc 28 as shown in FIG. 5, wherein the disc 28 is wrapped in the bag 54 and the garment 10 and further includes the cord 76. Because the flexible ring 66 may be removed, the disc 28 may also be removed from the garment 10. Thus, the disc 28 is removably attached to the garment 10.

Figure 14:
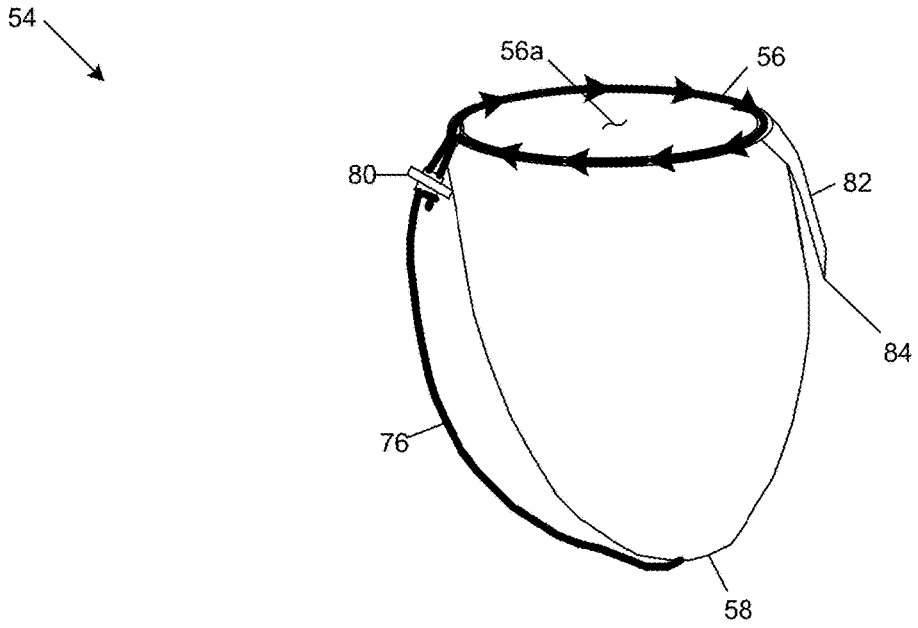
FIG. 14 is a diagram illustrating a blown-up perspective view of the bag.

FIG. 14 is a diagram illustrating a blown-up perspective view of the bag 54. People typically use certain equipment for dipping. For example, people may wear boots and gloves to keep warm in the cold water, and may have wallets and car keys. Thus, the bag 54 may be any size that is capable of carrying equipment used for dipping as well as other miscellaneous items but does not hang down below the bottom side 18 of the garment 10 during use.

The cord 76 extends from the bottom end 58 to the top end 56 of the bag 54 and extends about the circumference of the opening 56*a*. The cord 76 also includes a toggle 80. As a result, the cord 76 in the top end 56 of the bag 54 is configured to tighten and close the opening 56*a* to secure the garment 10 in the bag 54. Thus, it should be appreciated that the cord 76, or strap, can be operated as a pull string that facilitates opening and closing the bag 54 and can be swung over the shoulder of a person to function as a carrying strap.

The bag 54 also includes a flap 82 which functions to cover the opening 56*a* when the bag 54 is closed. The flap includes a first end which is attached to the bag 54 and a free end 84 which is not attached to the bag 54. The first end may be attached to the bag 54 in any manner, for example, by sewing. The flap 82 may be made of the same material as the garment 10 or from another water-resistant material.

Figure 15:
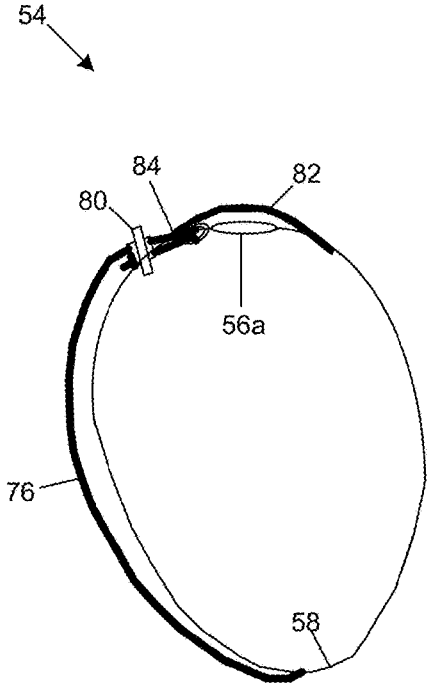
FIG. 15 is a diagram illustrating the blown-up perspective view of the bag as shown in FIG. 14, further including a flap in a closed position.

FIG. 15 is a diagram illustrating the blown-up perspective view of the bag 54 as shown in FIG. 14, further including the flap 82 in a closed position. The free end 84 of the flap 82 is removably attached to the bag 54. The free end 84 of the flap 82 may be removably connected to the bag 54 in any manner, for example, using a snap closure.

Figure 16:
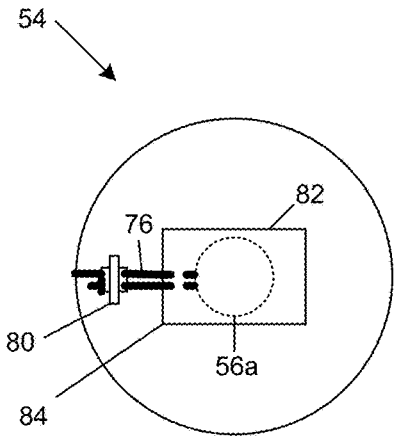
FIG. 16 is a top view of the bag in a closed state.

FIG. 16 is a top view of the bag 54 in a closed state. The flap 82 covers the cord 76 and opening 56*a* when the free end 84 is connected to the bag 54. The flap 82 facilitates preventing items from falling out of the bag.

After wading out of the water, a person could continue wearing the garment 10 while putting clothes on beneath the garment 10. When the person is adequately clothed, the garment is removed and wrapped-up into, for example, a pack or a folded state. The bag 54 is manipulated into a right-side-out orientation and the wrapped-up garment 10 is placed into the bag 54. It is contemplated by the present disclosure that the disc 28 facilitates turning the bag 54 into the right-side-out orientation as a person holds the disc 28 and places the garment 10 into the bag 54 as the bag 54 closes and changes to a carrying position. The disc 28 forms a base of the bag 54 after the garment 10 is placed into the bag 54 and the bag is closed.

Figure 17:
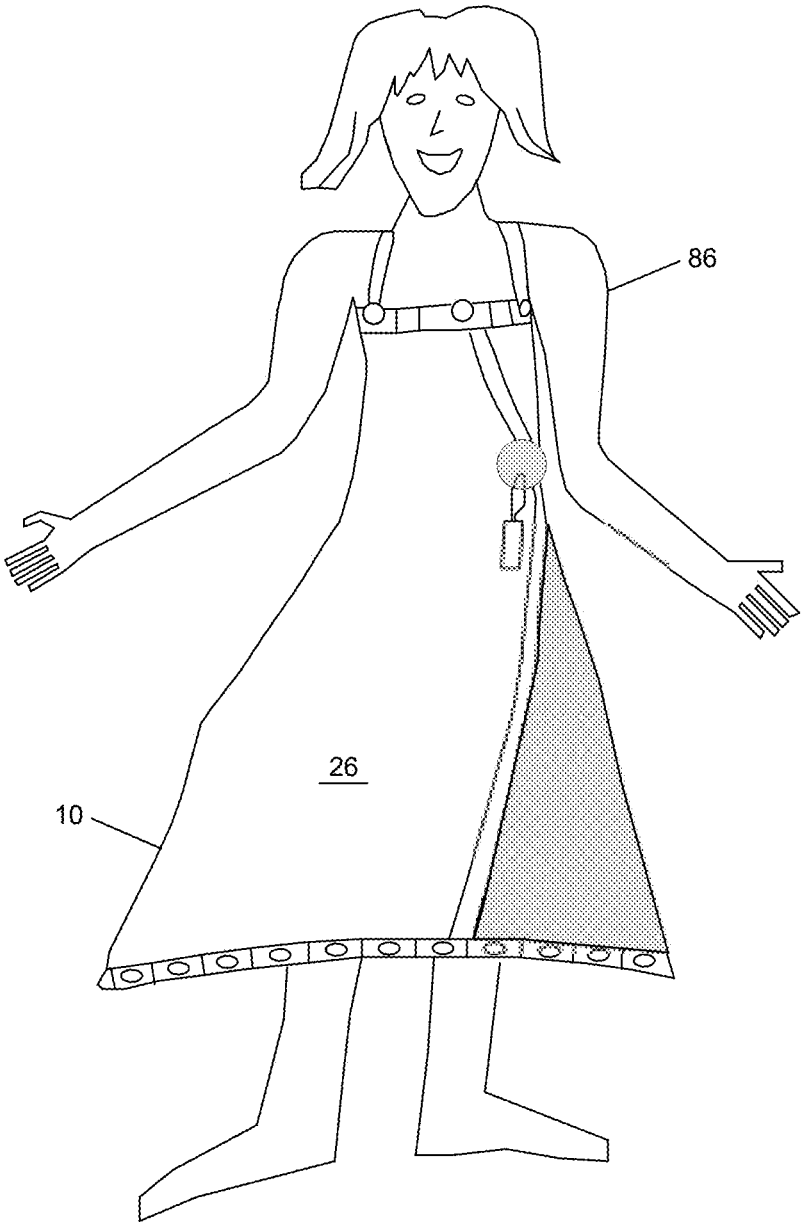
FIG. 17 is a diagram illustrating a front view of a woman wearing the garment.

FIG. 17 is a diagram illustrating a front view of a woman 86 wearing the garment 10. One end of the chest band 32 is arranged at the underarm of the woman 86. The garment 10 wraps around the chest to reach close to the other arm where the overlapping portions E and F overlap. The overlapping portions E and F form a diagonal line across the front of the woman 86. There is no undergarment attached to the garment 10. As a result, the garment 10 may be hygienically shared. The garment 10 has a generally rectangular shape but is fitted at the waist by the disc 28 that gathers the fabric. It is contemplated by the present disclosure that the orientation and of the garment may be reversed horizontally, right to left or left to right.

While dipping, when the shoulders of the person are immersed and while facing away from other people, the garment 10 can be privately opened below the water surface. More specifically, the magnets 40 can be separated and the disc 28 and button hole 30 can be operated to discretely open the garment 10 without others knowing. After the garment 10 is discreetly opened, privacy behind the person is maintained as the garment 10 acts as a screen curtain to cover the posterior aspect of the person.

A group of people can each use a garment 10. Typically, the people stand in a semicircle with their backs facing an entry point into the water and away from each other.

Figure 18:
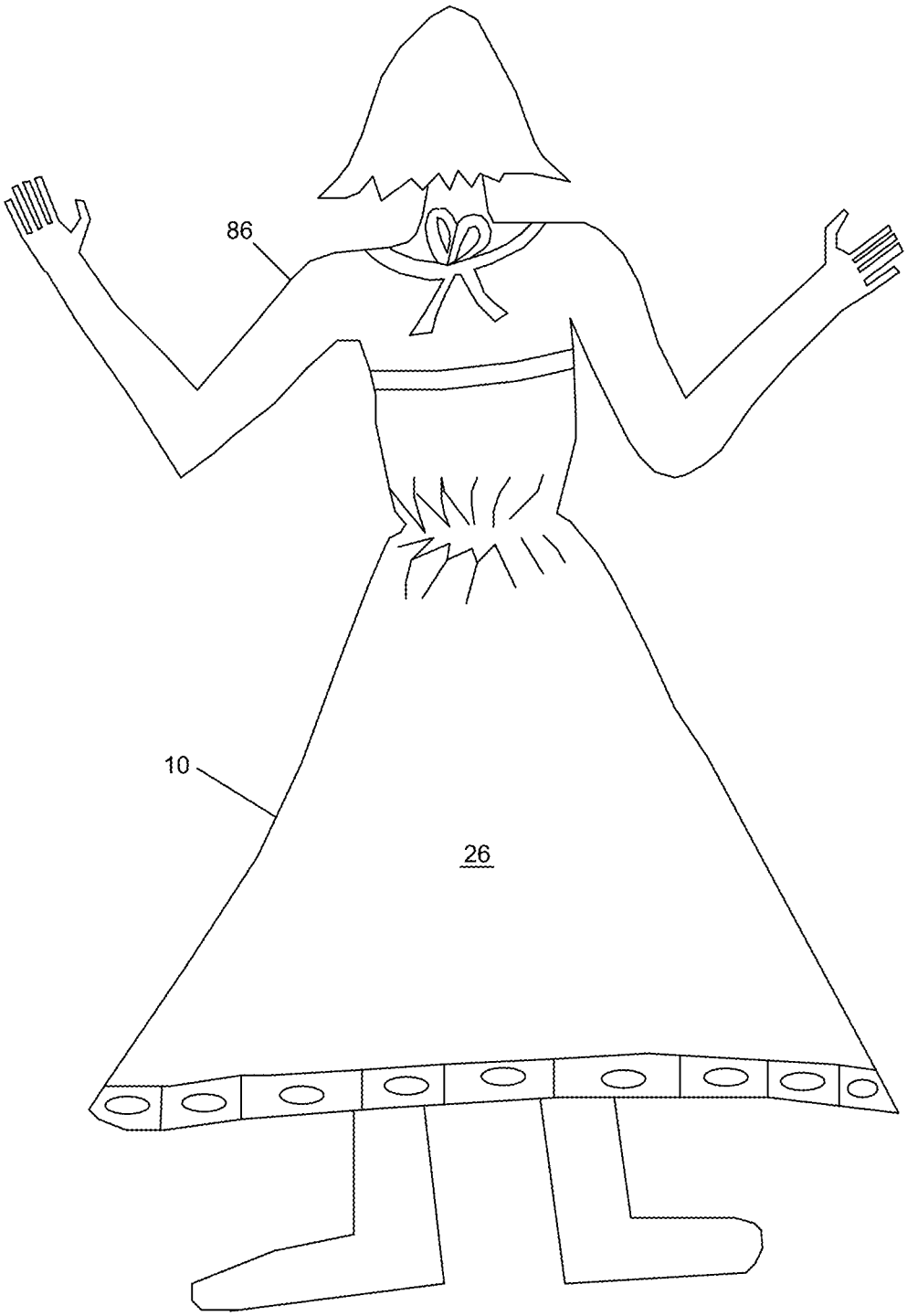
FIG. 18 is a diagram illustrating a rear view of the woman wearing the garment.

FIG. 18 is a diagram illustrating a rear view of the woman 86 wearing the garment 10.

People wishing to skinny dip in an area which is not private have to be covered on approaches into and out of the water and have been known to transition from a clothed state to an unclothed state using swimsuits or wraps. People have been known to wear their swim suits while approaching and wading into the water. Once immersed, people pull off and step out of their swim suits. When the dip is finished and while immersed in the water, people step back into their swim suits before wading out of the water. However, stepping into and out of the swim suits while in the water can be especially difficult in cold water because people may lose their balance while doing so. People have been known to fall into the water while stepping into or out of their swim suits and accidently submerging their heads which is unsafe and could perhaps expose the dipper for all to see.

Known wraps are for dry land use and if used in cold water can be difficult to open and close with gloves and cold hands. Additionally, wraps are not typically attached to the person so tend to float away while dipping. Thus, using swimsuits or wraps for a skinny dip can be awkward.

To address these problems a garment for enhancing privacy while dipping can be provided that includes a front face and a back face. The back face includes a bag in an inside-out orientation that has a top end and a bottom end. Furthermore, the garment includes a right side, a left side, a top side, a bottom side, and a disc having a first surface and a second surface. The disc is removably attached to the garment and is positioned at the bottom end of the bag to form a base of the bag.

The ease of changing into the garment 10 allows a person to change his or her mind about proceeding with a cold dip, dependent on time, weather, or water conditions and not be already and perhaps unnecessarily changed ahead of schedule.

Current water garments are designed to cover the body of a person while moving in the water, for example, for swimming, diving, and various other water sport activities. The garment 10 is not for covering the body of a person while moving in the water or any excessive movement while in water. Rather, the garment 10 is for a private naked dipping experience once immersed in water.

The garment 10 facilitates allowing a modest and covered wading in approach to the water, followed by a smooth transition to a discreet and private skinny dip which is screened by the opened garment 10 at the back and sides of the wearer. It remains loosely attached by the shoulder ties 44 which naturally slacken as the garment 10 is opened and therefore, it cannot float or be pulled away or become accidently entangled around the neck. The width of the opening of the garment 10 can be adjusted by the wearer by holding the ends 12, 14 at the top side 16 to adjust the opening when facing a more private direction such as the horizon, with your back to shorelines and with no one in front. It is not possible for any potential arriving onlookers to realize someone is skinny dipping as the transition to skinny dip is effortless. The garment 10 thus enables enhancing the number of people who can feel free in the water and prevent the violation of public nudity laws The garment 10 including the disc 28 and the bag 54 as described herein facilitates enhancing the convenience of discretely and privately transitioning from a clothed state to a nude state while outdoors. As a result, time spent searching for changing rooms is facilitated to be eliminated, concerns about the loss of balance and loss of clothing while transitioning between states is facilitated to be reduced, accidental body reveals are facilitated to be reduced and violations of public nudity laws are facilitated to be reduced. Accordingly, the privacy of a person before, during and after dipping is enhanced.

The above description provides examples, and is not limiting of the scope, applicability, or configuration set forth in the claims. Changes may be made in the function and arrangement of elements discussed without departing from the spirit and scope of the disclosure. Various embodiments may omit, substitute, or add various features as appropriate. For instance, features described with respect to certain embodiments may be combined in other embodiments.

What is claimed is:

1. A garment comprising:
a front face;
a right side;
a left side;
a top side;
a bottom side;
a back face, the back face including a bag in an inside-out orientation, the bag having a top end and a bottom end;
a button hole extending between the front and back faces; and
a disc having a first surface and a second surface, the disc being removably attached to the front face of the garment, being positioned at the bottom end of the bag to form a base of the bag, and being configured to cooperate with the button hole to close the garment about a person to enhance privacy before, during and after water dipping.

2. The garment according to claim 1, wherein:
a part of the garment is wrapped over the disc; and
a flexible ring is wrapped at least once about the front face of the garment proximate the second surface of the disc to removably attach the disc to the garment and to create a distance between the disc and the garment.

3. The garment according to claim 2, wherein the distance between the disc and the garment is variable.

4. The garment according to claim 1, wherein:
the top end of the bag includes an opening;
the top end of the bag faces the bottom side of the garment while the garment is worn by a person; and
the bottom end of the bag faces the top side of the garment while the garment is worn by the person.

5. The garment according to claim 1, wherein:
the garment is configured to be wrapped-up into the bag;
the top end of the bag includes an opening;
the bag is configured to be manipulated into a right side out orientation and to receive through the opening the wrapped-up garment in the right side out orientation;
a cord in the top end of the bag is configured to tighten and close the opening to secure the garment in the bag; and
a closure flap attached to the bag covers the top end of the bag.

6. The garment according to claim 1, wherein:
the bottom side of the garment extends a length of the garment from the right side to the left side; and
the bottom side of the garment includes a plurality of pockets, each pocket includes a weight.

7. The garment according to claim 1, wherein:
the top side of the garment extends between the right and left sides;
the top side includes a first row of pockets and a second row of pockets; and
one pocket in each row includes a magnet.

8. The garment according to claim 2, wherein:
the disc includes a concentric aperture;
a cord is securely attached to the disc; and
the cord extends through the aperture from the bottom end of the bag to the top end of the bag to function as a pull string to open and close the bag.

9. The garment according to claim 2, further comprising a device removably attached to the garment proximate the disc.

10. A garment comprising:
a front face, a back face, a right side, a left side, a top side, a bottom side, and a bag attached to the back face, the bag having a top end and a bottom end; and
the top side includes a first row of pockets and a second row of pockets, a first magnet is positioned in one of the first row pockets and a second magnet is positioned in one of the second row pockets, wherein:
the first and second magnets engage each other to securely close the garment about a person to prevent the person from being exposed before, during, and after water dipping; and
when the person wearing the garment is immersed in a natural body of water during dipping, the magnets can be manually disengaged by the person to open the garment below a surface of the natural body of water so the person can experience discrete natural nude water dipping.

11. The garment according to claim 10, wherein:
the garment includes straps configured to be tied behind a neck of the person while dipping; and
the tied straps prevent the garment from coming off the person while the person is immersed in water.

12. The garment according to claim 10, wherein:
the bottom side includes pockets, each pocket includes a weight; and
a force exerted by the weights on the garment exceeds a buoyant force of the water acting on the garment to cause the garment to remain on the person.

13. The garment according to claim 11, wherein after being manually disengaged the first and second magnets are configured to be re-engaged to securely close the garment about the person and the garment is configured to remain on the person while the person changes clothes beneath the garment.

14. The garment according to claim 13, wherein:
the garment is configured to be removed and wrapped-up after the person changes clothes; and
the bag is configured to be manipulated from an inside out orientation to a right side out orientation and to receive the wrapped-up garment in the right side out orientation.

15. The garment according to claim 10, further comprising a disc having a first surface and a second surface, the disc being removably attached to the front face of the garment and being positioned at the bottom end of the bag to form a base of the bag, the bag being in an inside out orientation.

16. The garment according to claim 15, wherein:

a part of the garment is wrapped over the disc; and a flexible ring is wrapped at least once about the front face of the garment proximate the first or second surface of the disc to removably attach the disc to the garment and to create a distance between the disc and the garment.

17. The garment according to claim 15, wherein:

the top side of the garment extends between the right and left sides;

the top side includes a first row of pockets and a second row of pockets; and one pocket in each row includes a magnet.

18. The garment according to claim 15, wherein:

the disc includes a concentric aperture;

a cord is securely attached to the disc and includes a toggle; and the cord extends through the aperture from the bottom end of the bag to the top end of the bag and the toggle allows the cord to function as a pull string to open and close the bag.

19. The garment according to claim 1, wherein the disc is configured to cooperate with the button hole to privately open the garment beneath a light reflective surface of a natural body of water while dipping when the chest is submerged and when facing away from people.

20. The garment according to claim 1, wherein the garment can be worn on the beach with swimwear underneath for coverup privacy.

* * * * *